US005165352A

United States Patent [19]

Ingram

[11] Patent Number: 5,165,352

[45] Date of Patent: Nov. 24, 1992

[54] HOLLOW NEEDLE TUFTING APPARATUS FOR PRODUCING PATTERNED FABRIC

[75] Inventor: Gary L. Ingram, Ooltewah, Tenn.

[73] Assignee: Tapistron International, Inc., Ringgold, Ga.

[21] Appl. No.: 815,334

[22] Filed: Dec. 27, 1991

[51] Int. Cl.[5] ..... D05B 15/16

[52] U.S. Cl. ..... 112/80.08; 112/80.7

[58] Field of Search ..... 112/80.07, 80.08, 80.7

[56] References Cited

U.S. PATENT DOCUMENTS

| | | | |
|---|---|---|---|
| 2,599,226 | 6/1952 | Briem | 112/80.08 X |
| 3,217,676 | 11/1965 | Short | 112/80.08 |
| 3,424,114 | 1/1969 | Short | 112/80.08 |
| 3,595,186 | 7/1971 | Shorrock | 112/80.08 |
| 4,549,496 | 10/1985 | Kile | 112/80.08 |
| 4,678,533 | 7/1987 | Bartlett | 112/80.07 X |
| 4,931,129 | 6/1990 | Bartlett et al. | 112/80.7 X |
| 4,991,523 | 2/1991 | Ingram | 112/80.08 X |
| 5,080,028 | 1/1992 | Ingram | 112/80.08 |

*Primary Examiner*—Werner H. Schroeder
*Assistant Examiner*—Paul C. Lewis
*Attorney, Agent, or Firm*—Alan Ruderman

[57] ABSTRACT

Tufting apparatus for producing textile goods includes a plurality of hollow needles which are reciprocated vertically to penetrate a backing. A selected yarn is fed pneumatically through a respective passageway into a yarn exchanger and through a respective needle and implanted into the backing, the backing being shifted transversely so that a transverse row of tufts is implanted across the backing. There are a series of passageways, each carrying a different yarn, communicating with each yarn exchanger. The selected yarn is fed by a yarn feed system and carried by high pressure air flowing in the passageway of the selected yarn, the yarn exchanger and the needle, while air flows in the other passageways under a lower pressure. The yarn exchanger has a funnel shape configuration and when a particular yarn is selected to be fed to the needle, another yarn is withdrawn from the needle to the inlet of the funnel. In order to prevent tangling of yarn within the funnel to preclude clogging at the inlet of the nozzle, an air jet is supplied within the funnel directed toward the inlet of the needle, the air jet being a nozzle positioned within the funnel.

6 Claims, 2 Drawing Sheets

HOLLOW NEEDLE TUFTING APPARATUS FOR PRODUCING PATTERNED FABRIC

BACKGROUND OF THE INVENTION

This invention relates generally to tufting apparatus for producing patterned textile goods such as carpet, upholstery, and the like, and more particularly to tufting apparatus having a yarn exchanger associated with each needle, at the inlet of which a plurality of yarns await the selective transportation of one such yarn to the needle and to which the yarn is subsequently retracted from the needle.

U.S. Pat. No. 4,549,496 which issued Oct. 29, 1985, to Kile discloses highly advantageous tufting apparatus for producing patterned tufted goods using yarns of different colors or different textures. This apparatus is capable of placing yarn into a backing to create patterns and designs which previously were generally available only from a weaving loom or by using printing techniques. The patented apparatus employs multiple heads spaced across the width of a backing material. Each head comprises a reciprocating hollow needle or backing opener tube for penetrating the backing and for implanting yarn tufts in the backing by feeding yarn through the needle pneumatically. The needle is connected to a yarn exchanger into which a plurality of yarns of different colors, for example, are supplied, and a mechanism is included which enables the selection of one or more of the yarns for implantation into the backing for each penetration by the needle. The multiple heads are stepped in synchronism across the backing for a distance corresponding to the spacing between the heads in order to implant a transverse row of yarn tufts. The backing is then advanced to the position of the next row and the process is repeated to implant the next row. A computer controls the selection of the yarn implanted by each backing opener for each penetration of the backing in order to produce a desired pattern in the finished goods.

A significant factor influencing the production speed of practical apparatus embodying the invention of the Kile patent is the number of tufting heads embodied in the apparatus. The greater the number of heads, the less distance each head must traverse and, accordingly, the faster a row of tufts can be implanted in the backing. As the number of heads increases, however, other problems arise. The increased weight makes it more difficult to move the heads accurately and to maintain their alignment and positions relative to one another. Thus rather than the multiple heads which carry the hollow needle being moved across the backing, Ingram U.S. Pat. No. 4,991,523 discloses the backing rather than the heads being shifted transversely to move substantially less weight transversely. This not only simplifies the transverse shifting apparatus but also provides greater speed and accuracy to the yarn placement.

Another significant factor influencing the cost and accuracy of such tufting apparatus is the control over the feeding of the yarn to the hollow needle. The feeding of the yarn must be positive, and when a yarn change is to be made for a particular needle the yarn previously stitched by that needle should be positively withdrawn from the needle so that the subsequent yarn will not be blocked by the previously sewn yarn. Unless this withdrawal of the previously sewn yarn is assured, a substantially greater air pressure is required to supply the subsequent yarn through the needle. Further more, when the yarn is withdrawn from the needle, unless the yarn withdrawal is controlled, the next time that yarn is required to be fed to the needle an accurate and consistent length of yarn cannot be assured. This would also result in requiring additional pressure to assure that a sufficient length of yarn is supplied. The effect is that a larger than required amount of pressure must be utilized, and if too much yarn is supplied to the needle additional yarn shearing operations are required for producing a satisfactory product.

This problem was solved by the apparatus disclosed in Ingram U.S. Pat. No. 5,080,028. There a pullback mechanism is disposed between a yarn feed roller and the hollow needle, the pullback mechanism acting to pull the yarn a preselected amount from the needle so that the yarn passageway in the needle is not restricted by the previous yarn when a subsequent yarn is to be sewn. Additionally, to assure that the pullback mechanism draws yarn from the needle and not from the yarn supply or the feed roller, clamping apparatus is disposed between the yarn feed roller and the pullback mechanism for positively clamping the yarn when a yarn change is to be made. The pullback mechanism is thereafter activated and the yarn feed roller ceases positive feeding of the yarn. Thus, the yarn pullback mechanism draws a predetermined amount of yarn from the needle maintaining it in reserve until again required. Additionally, the yarn feed roller as it ceased positive feeding draws a preselected amount of yarn from the yarn supply for immediate subsequent use when needed. When the needle is to commence stitching with a particular yarn, the yarn feed roller is activated and the yarn clamping apparatus and yarn pullback mechanism are deactivated.

A further significant factor effecting the efficiency and cost of the aforesaid apparatus and its operation is the amount of pressurized air that must be supplied to feed a selected yarn through the system from the one or two yarn ejectors which receive all of the yarn associated with the respective needle and direct the yarn through separate passageways to the yarn exchanger. The efficiency of this system can also effect the appearance of the product. In the aforesaid U.S. Pat. No. 4,549,496 air was supplied to a plenum from which the air was directed to a tapered space leading into each yarn carrying conduit extending to the yarn exchanger. Air was thus constantly supplied to the plenum under high pressure to drive the yarn fed by the yarn feed rollers. This resulted in a substantial amount of wasted air and the system was modified. As described in the aforesaid U.S. patent application, air flow is regulated and controlled so that air under a high pressure is only supplied to a passageway having the selected yarn for ejection into and through the needle, while air under a low pressure is supplied to the other passageways. This not only reduces the air requirements but provides better control of the yarn fed to the needle and permits the system to be quick acting. One problem that results, however, probably due to both the low and high pressure air flowing into the funnel shape of the yarn exchanger resulting in turbulence or a swirling action is that the various yarns can become tangled in the yarn exchanger at the inlet to the needle resulting in a clogging of the needle. When this occurs that needle becomes clogged and cannot feed yarn therethrough, i.e., it stops sewing yarn. The present invention is directed toward an effective and efficient solution to this difficulty.

SUMMARY OF THE INVENTION

Consequently, it is a primary object of the present invention to provide apparatus for producing tufted textile products including a hollow needle through which a selected one of a plurality of yarns is fed pneumatically for insertion into a backing material upon penetration of the needle into the backing, and a yarn exchanger communicating with the needle and to which the yarns are fed pneumatically through separate passageways communicating with the exchanger, the yarn exchanger having means for preventing the yarns from tangling therein.

It is another object of the present invention to provide apparatus for producing tufted textile products including a hollow needle through which a selected one of a plurality of yarns is fed pneumatically for insertion into a backing material upon penetration of the needle into the backing, and a yarn exchanger in the form of a funnel communicating with the needle and to which the yarns are pneumatically fed through separate yarn passageways communicating with the exchanger, the yarn exchanger having a nozzle disposed therein spaced from the entrance to the needle for blowing air into the needle to prevent the yarn from being deflected into tangling relationship with the other yarns.

Accordingly, the present invention provides tufting apparatus in which a plurality of yarns are disposed at the entrance to a yarn exchanger which in turn communicates with a hollow needle, one of the yarns being selectively released by feed means including pneumatic means and fed into the yarn exchanger and through the needle, the yarn exchanger having an air jet disposed adjacent the entry to the needle for blowing air into the needle inlet to prevent the selected yarn from being diverted and tangled with one or more of the other yarns. The yarn exchanger has the form of a funnel with each yarn adapted to enter the enlarged end through a separate passageway and the air jet is in the form of a nozzle disposed intermediate adjacent the exit end of the funnel so as to blow the selected yarn into the needle. The selected yarn is fed to the needle by high pressure air within its passageway while low pressure air flows through the other passageways. The air supplied by the nozzle appears to overcome the turbulence presented by the other air streams so that the selected yarn is fed through the exchanger and the needle without tangling with the other yarns and clogging the entry to the needle.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

As previously indicated, the present invention is particularly adapted for use with apparatus of the type disclosed in the previously referenced U.S. Pat. Nos. 4,549,496 and 4991,523, the disclosures of which are incorporated by reference herein for producing tufted textile products, such as carpet, wall coverings or upholstery. Details of structure and operation of the improved tufting apparatus of the present invention which are not directly related to the present invention and which are not described herein may be found by reference to the aforesaid patents.

Figure 1:
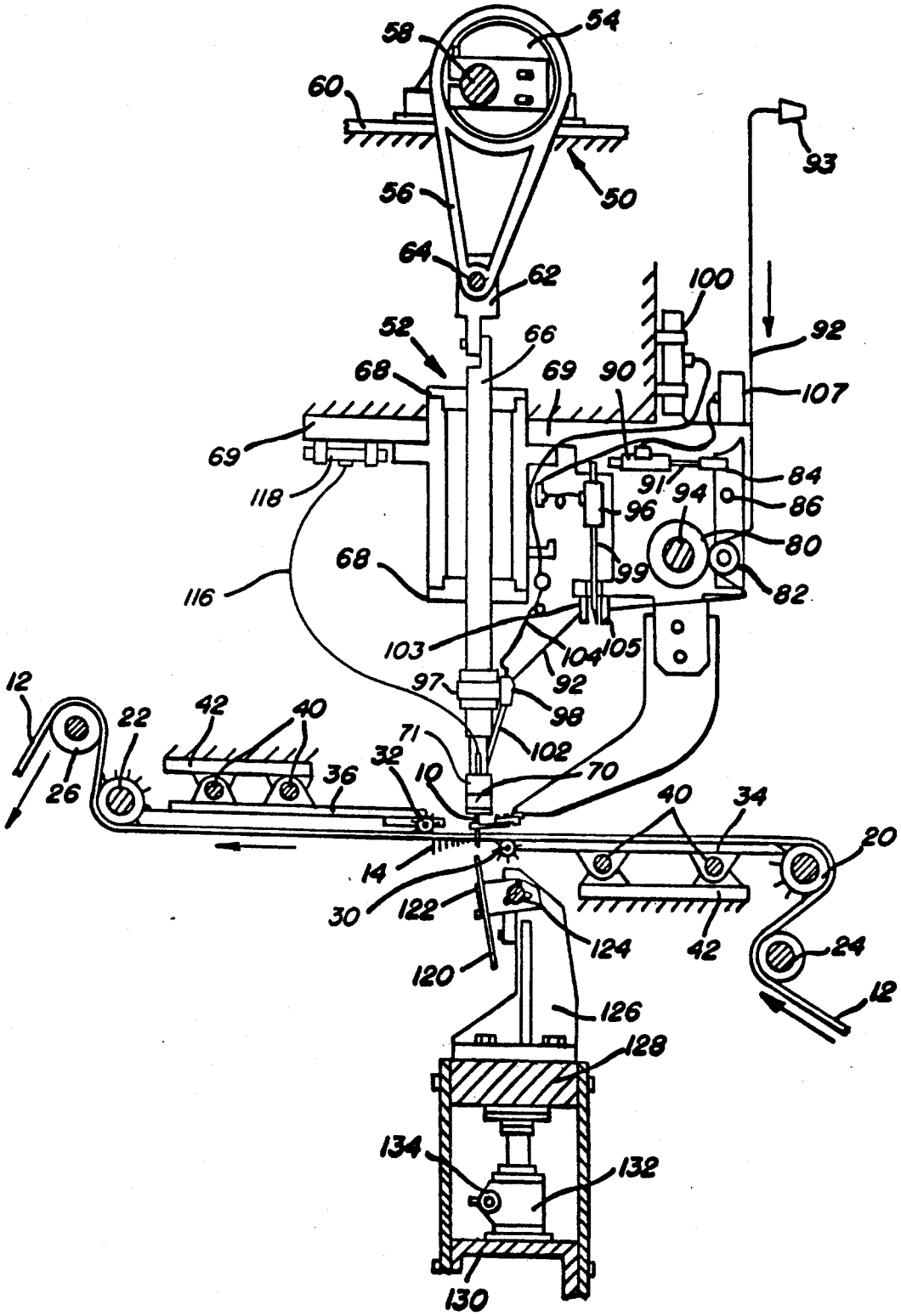
FIG. 1 is a side elevational view, partially in cross section and partially diagrammatic, of tufting apparatus embodying the invention.

The tufting apparatus of FIG. 1 comprises a plurality of reciprocating backing opener tube or needles 10 (only one of which is illustrated) which, since they are hollow needles, are referred to as backing openers or needles for penetrating a primary backing 12 to implant yarn tufts 14 therein. The primary backing 12, which may be in the form of a continuous running web, for example, may be advanced longitudinally past the reciprocating needles (to the left in FIG. 1 as indicated by the arrow) by a backing advance or feeding system which may comprise a pair of pin rollers 20 and 22 which are driven (as by electric motors which are not illustrated) at slightly different rotational speeds so as to maintain the backing under tension as it passes the reciprocating needles. The backing advance system may further comprise a pair of guide rollers 24 and 26 which cooperate with the pin rollers 20 and 22, respectively, to guide the backing. As shown in the figure and for reasons which will be described in more detail shortly, a second pair of pin rollers 30 and 32, which may have smaller diameters than pin rollers 20 and 22, may be located closely adjacent to the reciprocating needles 10 on opposite sides of the backing. Pin rollers 30 and 32 provide better control of the backing in the area where the tufts are implanted. As shown in the figure, pin roller 30 may be carried on a bed plate 34 at the lower side of the backing and be disposed adjacent to the location at which the needles penetrate the backing. Pin roller 32 may be carried on a second plate 36 disposed at the upper side of the backing and located just downstream from the reciprocating needles. Plates 34 and 36 are transversely shiftable relative to the backing advance direction for reasons which will be described.

Pin rollers 20 and 22 may also be carried on the shiftable plates 34 and 36, respectively, as indicated in the figure. To enable transverse movement each of the plates 34 and 36 may be carried on a pair of transversely extending shafts 40 which are supported by fixed portions 42 of the frame of the apparatus. Plates 34 and 36 may be mechanically connected together and to a transverse positioning mechanism (not illustrated) which enables the plates as well as the pin rollers and their associated drive system to be shifted in unison transversely to the longitudinal direction of advancement of the backing. This produces a corresponding transverse shifting movement of the backing so that each needle may insert yarn into the backing at a number of transverse locations. The transverse positioning mechanism may be any of a number of commercially available devices, such as pneumatic or hydraulic cylinders, or a ball screw drive, which are capable of producing very small and precisely controlled movements. Preferably, the positioning mechanism enables precisely controlled movements of the order of a tenth of an inch or less.

Rollers 24 and 26 may also be shifted transversely in correspondence with pin rollers 20 and 22 by a second, less precise shifting mechanism.

The needles 10 may be reciprocated by one or more adjustable cam assemblies 50 which are coupled to the needles by a respective link assembly 52. The adjustable cam assembly may comprise a circular cam lobe member 54 rotatably supported by bearings within a circular portion of a yoke member 56. The cam lobe member is carried on and driven by a transversely extending rotating shaft 58 which is offset from the center of the cam lobe member preferably supported by bearings on a fixed portion 60 of the frame as shown. The link assembly 52 may comprise a coupling link or clevis 62 which is pivotably connected to a yoke member 56 as shown at 64 and connected to a vertically extending push rod 66 guided for vertical reciprocating movement by bushings or bearings 68 supported by other fixed portions 69 of the frame. The lower ends of the push rods 66 are connected to a mounting bar 71 which in turn carries the yarn exchangers 70, each yarn exchanger carrying a respective one of the needles 10. Upon rotation of shaft 58, cam members 54 rotate to impart reciprocating movement to yoke members 56 and, in turn, a similar movement to the needles via the link assembly to cause the needles to penetrate and withdraw from the backing repetitively.

The tufting apparatus of FIG. 1 also includes systems for supplying and controlling the yarn which is implanted into the backing. These systems include a yarn feed system for positively supplying a predetermined length of selected yarn to the yarn exchanger for each needle. The yarn feed system comprises a drive roller 80 which cooperates with a feed roller 82 carried on a movable member 84 which is pivotably supported on a journal member 86 on the frame portion 69, there being one roller 82 carried on a member 84 for each yarn supplied to each needle or backing tube opener 10. Each feed roller 82 may be urged into engagement with a respective drive roller 80, which may be a single roller for a number of feed rollers, by means of a respective pneumatic actuator 90 or the like which is connected to the pivotable member 84 by means of a rod 91 extendable and rectractable from the actuator 90 so as to pivot the member 84 to urge the respective rollers 80 and 82 into contact with one another. Yarn 92 fed from a yarn supply such as a yarn cone 93 mounted on a creel (not illustrated) may be guided around the periphery of roller 82 so as to be between the engaging peripheral surfaces of rollers 80 and 82. The drive roller 80 may be supported on an incrementally rotated drive shaft 94 so that upon the shaft being rotated with the rollers 80 and 82 engaged, yarn is positively fed to the yarn exchanger 70 via a yarn pullback mechanism 96 and via a yarn ejector device 98. Thus, the yarn is trained so as to make a tortuous path about the roller 82 thereby resulting in a predetermined length of yarn being drawn from the yarn supply as the member 84 is pivoted to disengage the roller 82 from the roller 80. The yarn so drawn from the supply is thus ready for feeding toward the respective needle when the member 84 is again pivoted to engage the roller 82 with the roller 80.

Figure 2:
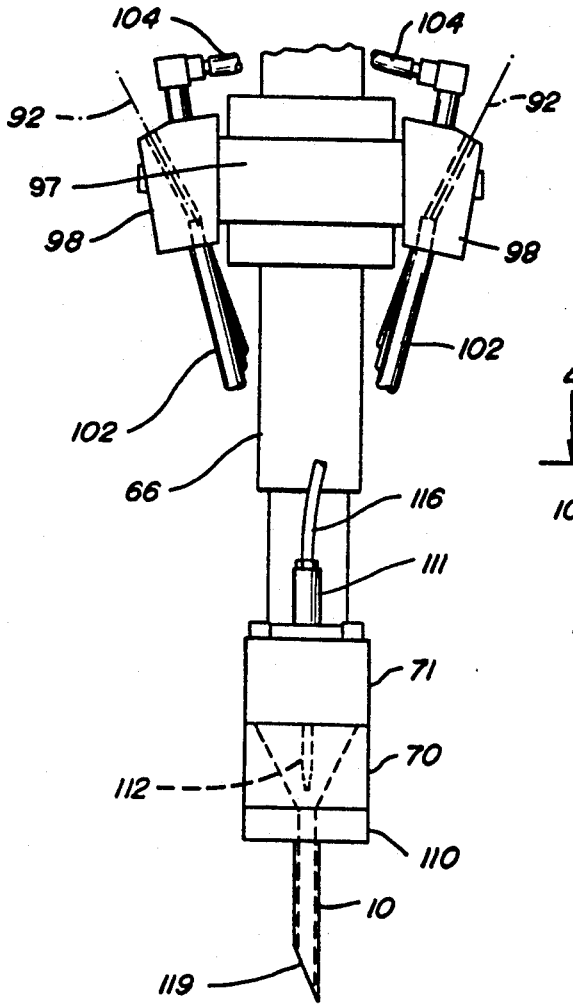
FIG. 2 is an enlarged fragmentary side view of the yarn exchanger and ejector portion of the apparatus illustrated in FIG. 1.

The yarn pullback mechanism 96 for each needle includes a rod or plunger 99 having a passageway or eyelet which moves relative to a pair of yarn guides 103,105 fixed to the frame, and the plunger 99 is disposed between the yarn guides 103,105. This mechanism acts to retract yarn from the needle 10 after a stitch has been formed and cut by the cutting apparatus hereinafter described and which is described in detail in U.S. Pat. No. 4,991,523, the yarn preferably being pulled into the yarn exchanger 70. One or more yarn ejector devices 98 associated with each needle is carried by an attachment bar 97 secured to the push rods. The ejector devices receive a plurality of different yarns (only one yarn 92 being illustrated in the drawings), each yarn having a separate passageway, along with pressurized air directed into each passageway from a pneumatic supply device 100. Preferably there is one ejector device for each needle, each device carrying six different yarns. For convenience adjacent needles have the respective ejectors mounted in staggered fashion so that one is on the front of the bar 97 and the next is on the rear of the bar as illustrated in FIG. 2 (but omitted in FIG. 1 for purposes of clarity). The supply device 100 supplies high pressure air to the passageway having yarn that has been selected for ejection into the needle or backing tube opener and supplies low pressure air to the other passageways, the pressure selection being by pressure regulators and control means (not illustrated). Each yarn strand entering the ejector devices 98 is fed to the yarn exchanger 70 through a separate supply tube 102 which connects the ejector device to the yarn exchanger. A separate air line 104 for each yarn tube 102 is connected to the ejector device 98 to enable compressed air to be ejected into each yarn passageway in a controlled manner selectively to transport the selected yarn pneumatically under the higher pressure through the tube to the backing opener. The low pressure air supplied to the ejector 98 and thus the other air supply tubes ensure that the other yarns are available without delay after another respective yarn has been selected to be transported to the needle or backing tube opener. Additionally, the same or preferably, another pneumatic supply 107 may supply pressurized air to the actuator 90 and the pullback mechanism 96.

The yarn ejector devices 98, yarn supply tubes 102 and yarn exchanger 70 together function in a similar manner to the yarn exchanger described in U.S. Pat. No. 4,549,496 and operate in a similar manner. In the aforesaid patent, however, the yarn exchanger and the yarn ejection device were incorporated into a common unit while in the present apparatus the tubes 102 extend from the respective yarn ejector into corresponding passageway forming bores 106 in the mounting bar 71, the bores communicating with the funnel shaped interior 108 of the yarn exchanger 70. Thus, a particular yarn may be selected for implantation into the backing by appropriately controlling the air supplied to the respective pneumatic actuator 90 to pivot the member 84 associated with the selected yarn so that the corresponding feed roller 82 is moved into engagement with the drive roller 80; by controlling the air supplied to the yarn pullback mechanism 96 to extend the plunger 99 and release the yarn previously drawn from the yarn supply; and by controlling the compressed air supplied by the supply 100 to the ejector devices 98 to transport the selected yarn to the yarn exchanger when the actuator 90 is actuated to extend the rod 91. Thus, the member 84 is pivoted to force the roller 82 against the roller 80 so that the yarn 92, which initially is the yarn held in reserve, is fed toward the respective needle or backing opener tube. Additionally, the plunger 99 is extended from the pullback mechanism 96 so that the eyelet or passageway therein is aligned with the guides 103, 105 to permit the yarn to be fed toward the needle, the extension of the rod 91 and the plunger 99, together with the change from low pressure to high pressure for the selected yarn passageway occurring substantially simultaneously. When the actuator 90 is controlled to retract the rod 91, the member 84 is pivoted to disengage the roller 82 from the roller 80 and terminate the feeding of the previously fed yarn. Also, the plunger 99 is retracted into the pullback mechanism to draw back yarn that has been fed but not used by the needle and held ready, as in a storage tank or plenum, until that yarn is again fed. The pullback mechanism 96 thus ensures that a previously fed yarn is drawn back into the vicinity of, and preferably into, the yarn exchanger 70 so that a blockage does not occur within the needle 10 which would restrict the feeding of the subsequently fed yarn. This permits substantially less air pressure to be required to feed the yarn from the yarn exchanger to the needle. A clamping means (not illustrated) between the pullback mechanism and the feed roller 82 ensures that yarn is drawn back from the needle rather than from the yarn supply, and to preclude any yarn from being drawn from the reserve resulting when the feed roller 82 is moved out of engagement with the drive roller 80, and also ensures that the extra yarn drawn by roller 82 when moving from roller 80 is available to be supplied to the needle.

As aforesaid, a yarn which was previously fed to the needle is withdrawn into the funnel 108 of the yarn exchanger, preferably to the inlet thereof at the interface with the outlet of the passageway 106, when another yarn is selected to be fed to the needle. Additionally, there is air turbulence within the funnel 108 due to the air flowing therethrough, i.e., the air flowing through the tubes 102 and the passageways 106, enters the funnel 108, and exits openings 109 at the interfaces between the yarn exchanger with the mounting bar 71 and with a needle holder or clamp 110 secured to the yarn exchanger. It has been found that these factors result in a tangling of the yarns within the funnel 108 resulting in the needle becoming clogged so the yarns may not be fed therethrough. This difficulty has been alleviated by the present invention by disposing a source of high pressure air within the funnel spaced from the needle inlet. Thus, the present invention fastens a collar 111 to a tube 112 and secures the collar within a bore in the mounting bar 71, the tube 112 having an outlet 114 disposed within the funnel spaced slightly from the inlet to the needle 10. An air supply line 116 is connected to and communicates the tube with a source of pressurized air 118 which blows air into the outlet of the funnel above the inlet to the needle. It has been found that by supplying air to the tube 112 under a pressure substantially equal to that of the air flowing through the supply tube 102 corresponding to the selected yarn, tangling of the yarn within the funnel and clogging of the needle is precluded. Thus, the air pressure for the selected yarn passageway and the tube 112 may be in the order of 80 psi while the air pressure in the other passageways are in the order of 30 psi.

The tufting apparatus in FIG. 1 employs a plurality of transversely stationary needles and may employ several adjustable cam assemblies 50 spaced transversely across the width of the backing and connected to shaft 58 to reciprocate the needles in synchronism to penetrate the backing. Each needle implants one or more selected yarns as determined by a control system such as a computer which controls the yarn supplying and other systems of the apparatus. In order to implant a transverse row of tufts, the backing is shifted transversely, as previously described, in small increments corresponding to the spacing between adjacent tufts. By using a large number of needles spaced apart by relatively small spacings, e.g., 2.5 inches, the backing need be shifted transversely only by this rather small total distance in order to implant a complete transverse row of tufts.

Figure 3:
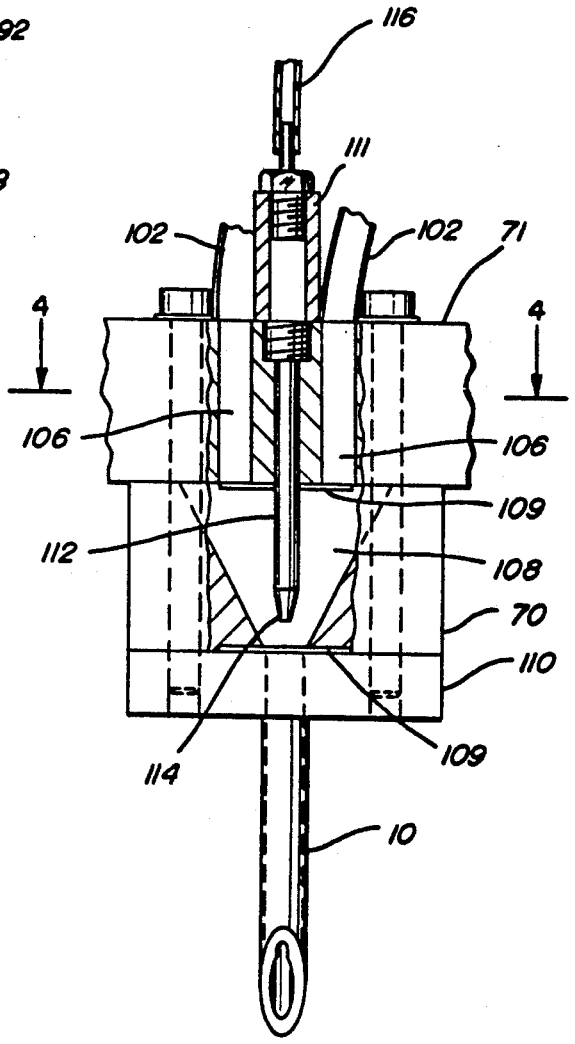
FIG. 3 is a rear elevational view of the yarn exchanger illustrated in FIG. 2, partly in cross section.
Figure 4:
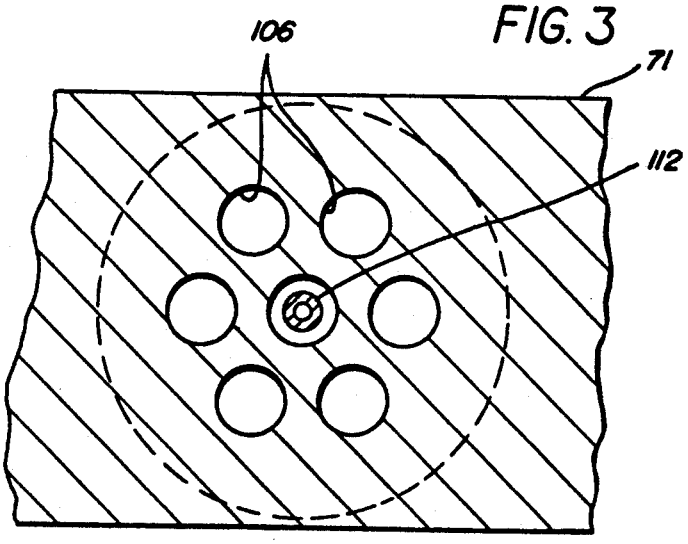
FIG. 4 is a cross sectional view taken substantially along the line 4—4 of FIG. 3.

As illustrated in FIG. 1, and as described in detail in the aforesaid U.S. Pat. No. 4,991,523, the tufting apparatus includes a cutting mechanism comprising a separate knife blade 120 for each needle. The blades are disposed on the opposite side of the backing from the needles and the needle reciprocating mechanism, as indicated in FIG. 1, and are arranged to cooperate with the needles by sliding over the respective angled surface 119 which forms the pointed tip of the hollow needle as illustrated in FIGS. 2 and 3, in a shearing-like action to cut yarn that is ejected from the needles. As shown in FIG. 1, knife blade 120 may comprise a flat elongated strip of metal, such as steel, which is held clamped in a knife block 122 disposed on a transversely spaced brackets 126 (only one of which is illustrated) connected to a transversely extending frame member 128. The brackets 126 may be clamped tightly to shaft 124 normally to hold the shaft stationary, and means may be provided to permit the shaft to be rotated to change the angle between the knife blade and the needle and to shift the knife blades transversely as necessary. Frame member 128 is preferably supported on a fixed member 130 of the apparatus frame by several screw-type jacks 132 (only one being shown) which are spaced transversely in the apparatus. The control shafts 134 of the jacks may be connected together by control rods so that the jacks may be lowered and raised in unison to adjust the positions of the knife blades relative to the backing.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. Apparatus for producing patterned tufted fabric goods comprising a hollow needle having an inlet and an outlet at a pointed tip, means for reciprocably driving said needle for penetrating a backing with said point for implanting yarn therein, a yarn exchanger having an inlet and an outlet communicating with the inlet of said needle, a plurality of yarn supply tubes converging at the inlet of said yarn exchanger for conveying a plurality of different yarns entering the tubes to the yarn exchanger, pneumatic means for producing an air flow through each yarn supply tube and into said yarn exchanger, the pressure of the air through at least one supply tube being greater than the pressure of the air through the other tubes for transporting the yarn therein through said yarn exchanger and said needle when yarn is fed to said one supply tube, means for feeding yarn selectively to said one supply tube to transport yarn through said yarn exchanger and through said needle for implantation into said backing at each penetration thereof, and pneumatic means for communicating pressurized air independently of said supply tubes through said yarn exchanger and into the inlet of said needle to prevent tangling of yarn within said yarn exchanger.

2. Apparatus as recited in claim 1, wherein said yarn exchanger comprises a funnel-shape interior having a large open end and a small open end, the outlet of said yarn exchanger comprising said small open end, said pneumatic means including a conduit extending through said large end and disposed within said funnel shape interior, said conduit having an outlet disposed adjacent said inlet of said needle.

3. Apparatus as recited in claim 2, wherein said means for reciprocably driving said needle comprises reciprocating push rod means, a mounting bar carried by said push rod means, means for fastening said yarn exchanger to said mounting bar, said mounting bar having means for communicating said yarn supply tubes with said yarn exchanger and means for mounting said conduit.

4. Apparatus as recited in claim 1, wherein the pressure of said air communicated through said yarn exchanger independently of said supply tubes is substantially equal to the pressure of the air in said one supply tube.

5. Apparatus as recited in claim 4, wherein said yarn exchanger comprises a funnel-shape interior having a large open end and a small open end, the outlet of said yarn exchanger comprising said small open end, said pneumatic means including a conduit extending through said large end and disposed within said funnel shape interior, said conduit having an outlet disposed adjacent said inlet of said needle.

6. Apparatus as recited in claim 5, wherein said means for reciprocably driving said needle comprises reciprocating push rod means, a mounting bar carried by said push rod means, means for fastening said yarn exchanger to said mounting bar, said mounting bar having means for communicating said yarn supply tubes with said yarn exchanger and means for mounting said conduit.

* * * * *